US008337177B2

(12) United States Patent
Mezza et al.

(10) Patent No.: US 8,337,177 B2
(45) Date of Patent: Dec. 25, 2012

(54) VALVE PLATE FOR A COMPRESSOR, AND METHOD FOR COOLING COMPRESSED AIR IN A VALVE PLATE OF A COMPRESSOR

(75) Inventors: Jean-Louis Mezza, Marolles (FR); Yvan Baptiste, St. Denis (FR)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 60 days.

(21) Appl. No.: 12/894,774

(22) Filed: Sep. 30, 2010

(65) Prior Publication Data

US 2011/0070101 A1 Mar. 24, 2011

Related U.S. Application Data

(63) Continuation of application No. PCT/EP2009/002167, filed on Mar. 25, 2009.

(30) Foreign Application Priority Data

Apr. 11, 2008 (DE) ..... 10 2008 018 467

(51) Int. Cl.
*F04B 39/06* (2006.01)

(52) U.S. Cl. ..... 417/438; 417/452

(58) Field of Classification Search ..... 417/438, 417/452; 137/516.11; 165/108, 112
See application file for complete search history.

(56) References Cited

U.S. PATENT DOCUMENTS

| | | | | |
|---|---|---|---|---|
| 2,449,408 | A * | 9/1948 | Naab | 417/432 |
| 3,823,725 | A | 7/1974 | Akiyama et al. | |
| 2004/0086406 | A1 | 5/2004 | Lee | |
| 2007/0081910 | A1 * | 4/2007 | Butler et al. | 417/571 |

FOREIGN PATENT DOCUMENTS

| | | |
|---|---|---|
| DE | 866 712 | 2/1953 |
| DE | 24 10 705 A1 | 9/1975 |
| DE | 41 31 886 A1 | 4/1993 |
| DE | 195 35 079 C2 | 4/1996 |

OTHER PUBLICATIONS

International Search Report dated Oct. 2, 2009 with English translation (four (4) pages).
German Office Action dated Feb. 18, 2009 with English translation (four (4) pages).

* cited by examiner

*Primary Examiner* — Charles Freay
*Assistant Examiner* — Patrick Hamo
(74) *Attorney, Agent, or Firm* — Crowell & Moring LLP

(57) ABSTRACT

A valve plate includes a cooling medium duct for a compressor used for generating compressed air. From the perspective of a piston chamber of the compressor, at least part of the cooling medium duct extends between the piston chamber and an air discharge valve that is arranged in the valve plate. A method for cooling compressed air in a valve plate of a compressor is also provided.

10 Claims, 3 Drawing Sheets

VALVE PLATE FOR A COMPRESSOR, AND METHOD FOR COOLING COMPRESSED AIR IN A VALVE PLATE OF A COMPRESSOR

CROSS-REFERENCE TO RELATED APPLICATIONS

This application is a continuation of PCT International Application No. PCT/EP2009/002167, filed Mar. 25, 2009, which claims priority under 35 U.S.C. §119 from German Patent Application No. DE 10 2008 018 467.5, filed Apr. 11, 2008, the entire disclosures of which are herein expressly incorporated by reference.

BACKGROUND AND SUMMARY OF THE INVENTION

The invention relates to a valve plate having a coolant duct for a compressor for generating compressed air.

The invention also relates to a method for cooling compressed air in a valve plate of a compressor, with the valve plate comprising a coolant duct.

Modern commercial vehicles, which are used in rail or road traffic, are equipped with numerous subsystems that consume compressed air. These subsystems include, for example, a service brake operated with compressed air, and an air suspension system. The supply of compressed air to the compressed air consumers is realized by means of a compressed air supply device, which includes a compressor. Ambient air is sucked in and compressed by the compressor, and before being used in the consumers, is cleaned of foreign constituents such as oil and water in further components of the compressed air supply device.

During the compression of the air in the compressor, the air is heated considerably. The heating action is increased with rising delivery pressure and rising rotational speed of the compressor. This is a disadvantage in terms of the further treatment of the compressed air, in particular the air drying. The air moisture is conventionally extracted from the air in an air filter cartridge positioned downstream of the compressor. The air filter cartridge contains a drying agent which can extract moisture from the air only up to at most 80° C. A lower maximum admissible temperature of 60° C. is therefore usually specified in order to enable effective drying. During the compression in the compressor, however, the compressed air reaches temperatures of up to 320° C. at the outlet opening of the piston chamber. At the outlet of the compressor itself, the temperatures may still be at most 220° C. This makes it necessary to cool the air between the compressor and the air filter cartridge. For this purpose, in the prior art, use is made of a pressure line of several meters in length, with it being possible for the heated compressed air to cool down as it flows through the pressure line from the compressor to the air filter cartridge, without further cooling measures. Disadvantages here are the pressure loss as a result of the long line and the structural expenditure that the pressure line itself entails.

To be able to shorten the long pressure line between the compressor and filter cartridge, it is necessary to cool the compressed air by means of active cooling. For this purpose, a so-called supercooling plate is inserted in the cylinder head of the compressor above the valve plate, which supercooling plate is traversed by a coolant and functions as a heat exchanger. By use of the supercooling plate, it is possible to lower the outlet temperature of the compressed air to 140 to 150° C. at the compressor outlet, and to shorten the adjoining pressure line by 5 to 30%. An example of a supercooling plate of this type can be found in DE 195 35 079 C2.

A disadvantage here is, in particular, the complex design resulting from the integration of the supercooling plate as a separate component into the cylinder head of the compressor, because this makes additional seals necessary.

The object on which the invention is based is that of providing a valve plate which, without a supercooling plate, provides at least the same cooling performance as a combination of a conventional valve plate and a supercooling plate.

The invention builds on the generic valve plate in that the coolant duct runs, as viewed from a piston chamber of the compressor, at least partially between the piston chamber and an air outlet valve arranged in the valve plate. As a result of this profile of the coolant duct, the entire valve plate can be cooled uniformly, with it being possible in particular for the temperature of the valve plate to be lowered in the region of the air outlet valve, which consequently increases the attainable cooling performance. The heated compressed air is therefore cooled by the coolant present in the coolant duct from the moment the compressed air reaches the air outlet valve. In particular with a viewing direction pointing perpendicularly at the valve plate from the piston chamber, it is even possible for the coolant duct to run at least partially in front of the air outlet valve.

It is expediently provided here that the coolant duct runs at least partially in a meandering fashion in a base of the valve plate. As a result of the meandering profile or course of the coolant duct in the base of the valve plate, the contact area of the coolant duct with the valve plate is increased, as a result of which greater cooling performance can be provided.

Here, it may also be provided that an air guide runs in a meandering fashion in a body of the valve plate. The meandering profile or course of the air guide also increases the attainable cooling performance since the contact surface of the medium to be cooled with the cooled valve plate is increased.

It is preferably also provided that a plurality of air outlet valves are arranged in a body of the valve plate. The simultaneous use of a plurality of air outlet valves reduces throttling losses caused by a restricted valve cross section. In this connection, the heat generation at the air outlet valves is also reduced.

The invention also relates to a compressor having a valve plate according to the invention.

The generic method is developed further in that the coolant is conducted, as viewed from a piston chamber of a compressor, at least partially between the piston chamber and an air outlet valve arranged in the valve plate. In this way, the advantages and peculiarities of the valve plate according to the invention are also implemented within the context of a method. This also applies to the particularly preferred embodiments of the method according to the invention specified below.

The method is expediently developed further in that the coolant is conducted in a meandering fashion in a base of the valve plate.

It is preferably also provided that the compressed air is conducted in a meandering fashion in a body of the valve plate.

It may also be provided that the compressed air flows into a body of the valve plate through a plurality of air outlet valves.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
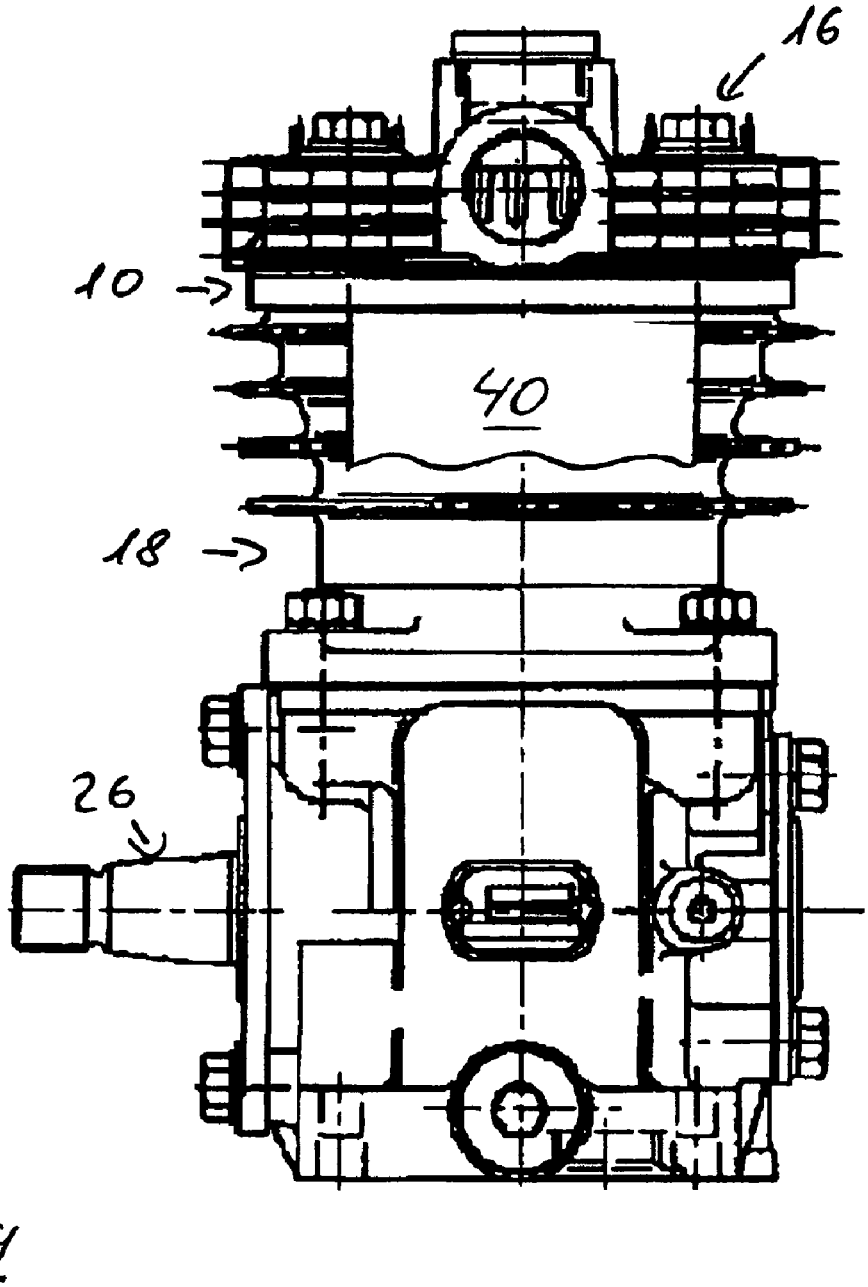
FIG. 1 is an external view of a compressor with a cut-away piston housing.

In the following drawings, the same reference numerals are used to denote identical or similar parts.

FIG. 1 is an external view of a compressor with a cut-away piston housing. The illustrated compressor 14 includes a cylinder head 16 and a piston housing 18, with a valve plate 10 being arranged between the piston housing 18 and the cylinder head 16. The compressor 14 is driven via a shaft 26. The piston housing 18 has been cut away in the vicinity of the valve plate 10, such that a piston chamber 40 is visible. A piston (not visible in the illustration) moves up and down in the interior of the piston chamber 40.

Figure 2:
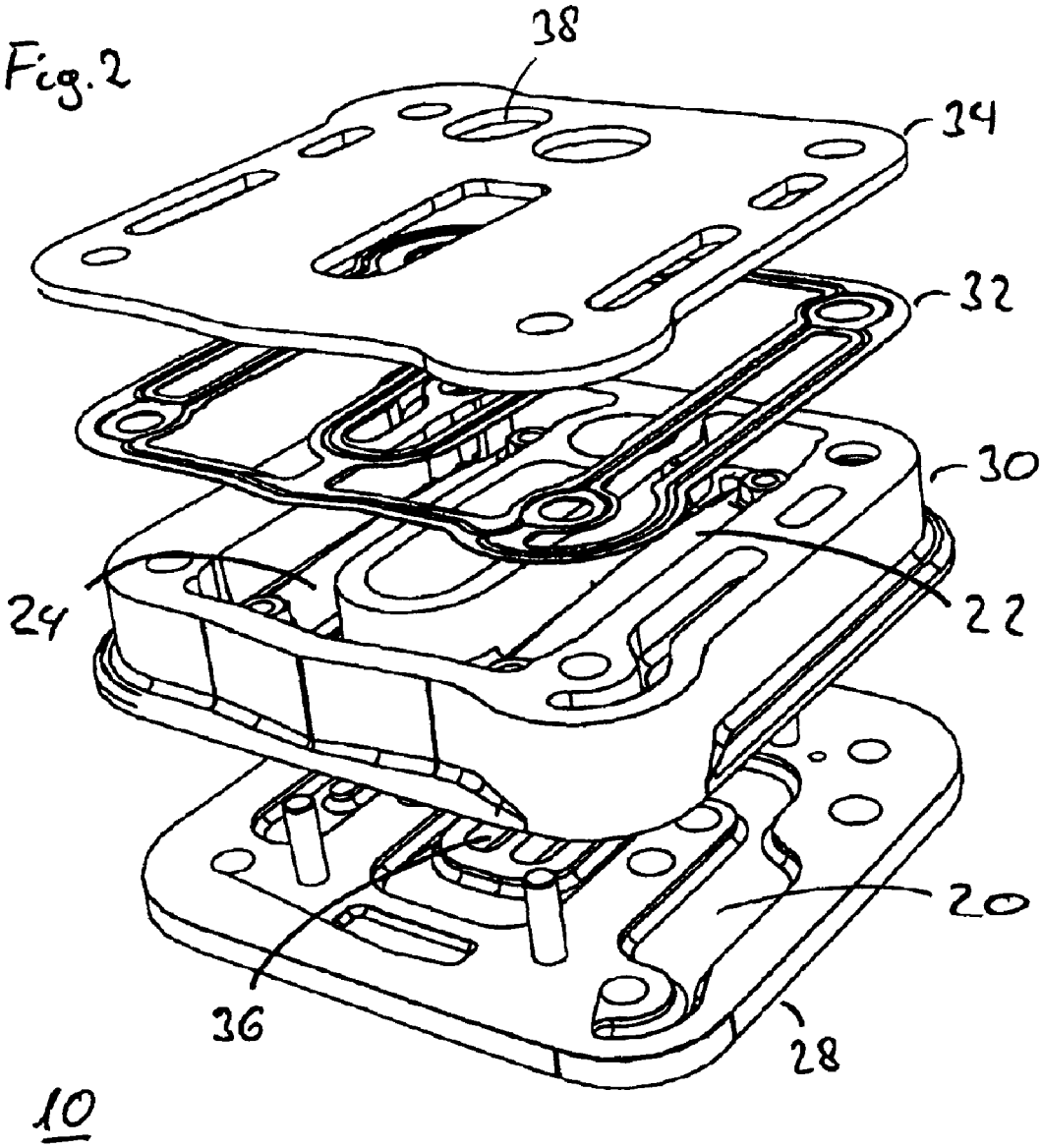
FIG. 2 is an exploded illustration of a valve plate according to an embodiment of the invention.

FIG. 2 shows an exploded illustration of an exemplary valve plate according to the invention. The illustrated valve plate 10 comprises, from bottom to top, a base 28, a body 30, a seal 32 and a cover 34. The cover 34 and the body 30 are sealingly connected to one another by the seal 32, while the body 30 and the base 28 are sealingly connected to one another by soldering or adhesive bonding. It is, however, also contemplated for a seal to be inserted between the base 28 and the body 30. Formed into the base 28 is a coolant duct 20, which runs in a meandering fashion within the base 28. The coolant duct 20 is delimited in the upward direction by the body 30. Furthermore, an air inlet valve 36 is visible in the central region of the base 28. Arranged in the body 30 are two air outlet valves 22, 24 via which the compressed air flows into the valve plate 10. Here, viewed from the base 28 in the direction of the body 30, the coolant duct 20 conceals a part of the air outlet valves 22, 24. The compressed air can finally leave the valve plate 10 again through an air outlet 38 in the cover 34 of the valve plate 10.

Figure 3:
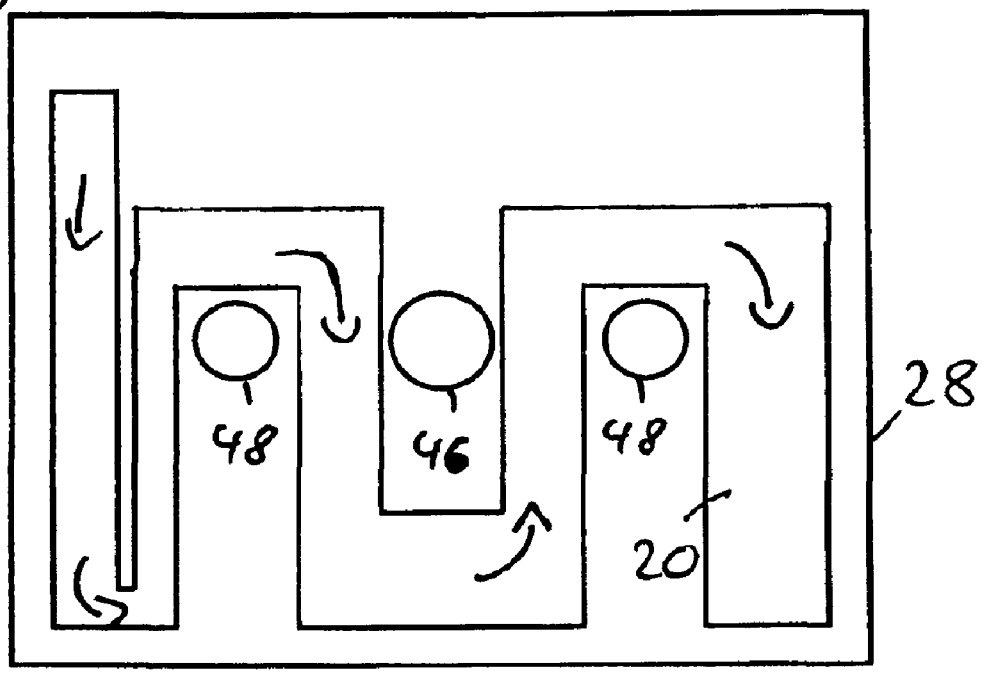
FIG. 3 is a plan view of a base of a valve plate according to an embodiment of the invention.

FIG. 3 shows a plan view of a base of an exemplary valve plate according to the invention. The illustrated base 28, having the coolant duct 20 running in a meandering fashion, has a plurality of bores through which air can pass through the base 28. Arranged in the central region is an air inlet 46, which belongs to the air inlet valve 36 (not illustrated here). Furthermore, the coolant duct 20 flows around two piston chamber air outlets 48, which belong to the air outlet valves 22, 24 (not illustrated here). The arrows depicted in the coolant duct 20 indicate an exemplary flow direction of the coolant within the base 28. The piston chamber air outlets 48 form, together with diaphragms (not illustrated here), the air outlet valves 22, 24, with the diaphragms being partially concealed by the coolant duct 20 as viewed from the piston chamber 40, as can be seen from FIG. 2. This is also true in particular when the viewing direction is perpendicular to the plane of the valve plate.

Figure 4:
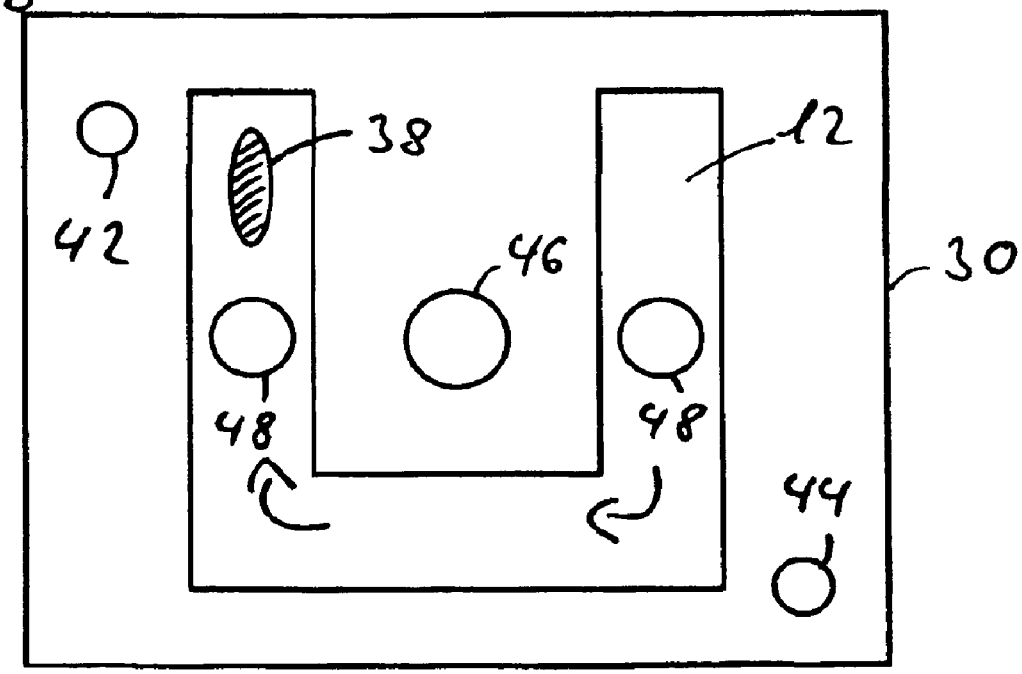
FIG. 4 is a plan view of a body of a valve plate according to an embodiment of the invention.

FIG. 4 shows a plan view of a body of an exemplary valve plate according to the invention. The illustrated body 30 has an air guide 12 in which the air flowing in through the piston chamber air outlets 48 is conducted to an air outlet 38. Like the air inlet 46, the piston chamber air outlets 48 are bores through the body 30. In contrast, the air outlet 38 is not a bore in the body 30, but rather is present in the form of a bore in the cover 34 (not illustrated here) of the valve plate. The air guide 12 serves to guide the compressed air from the piston chamber air outlets 48 to the air outlet 38. Also shown in the body 30 are a coolant inlet 42 and a coolant outlet 44 via which the coolant can circulate through the coolant duct 20 illustrated in FIG. 3.

Table of Reference Numerals

| | |
|---|---|
| 10 | Valve plate |
| 12 | Air guide |
| 14 | Compressor |
| 16 | Cylinder head |
| 18 | Piston housing |
| 20 | Coolant duct |
| 22 | Air outlet valve |
| 24 | Air outlet valve |
| 26 | Shaft |
| 28 | Base |
| 30 | Body |
| 32 | Seal |
| 34 | Cover |
| 36 | Air inlet valve |
| 38 | Air outlet |
| 40 | Piston chamber |
| 42 | Coolant inlet |
| 44 | Coolant outlet |
| 46 | Air inlet |
| 48 | Piston chamber air outlet |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A valve plate for a compressor having a piston chamber, the valve plate comprising:

an air outlet valve arranged in the valve plate; a coolant duct extending, at least partially between the piston chamber and the air outlet valve when viewed from the piston chamber of the compressor; and an air guide having a meandering course in a body of the valve plate, wherein the air guide is arranged in a plane of the valve plate, and the coolant duct operates to cool compressed air generated by the compressor as compressed air from the piston chamber passes through the air guide.

2. The valve plate according to claim 1, wherein the coolant duct has an at least partially meandering course in a base of the valve plate.

3. The valve plate according to claim 1, wherein more than one air outlet valve is arranged in a body of the valve plate.

4. A compressor, comprising: a piston chamber; a valve plate having a coolant duct, the coolant duct running at least partially between the piston chamber and an air outlet valve arranged in the valve plate viewed from the piston chamber of the compressor, and an air guide having a meandering course in a body of the valve plate, wherein the air guide is arranged in a plane of the valve plate, and the coolant duct operates to cool compressed air generated by the compressor as compressed air from the piston chamber passes through the air guide.

5. The compressor according to claim 4, wherein the coolant duct is arranged at least partially with a meandering course in a base of the valve plate.

6. The compressor according to claim 5, wherein more than one outlet valve is arranged in the body of the valve plate.

7. A method for cooling compressed air in a valve plate of a compressor, the method comprising the acts of:

producing compressed air via a piston chamber of the compressor; and cooling said compressed air via a coolant conducted through a coolant duct at least partially between the piston chamber and an air outlet valve arranged in the valve plate when viewed from the piston chamber of the compressor, wherein the act of producing compressed air further comprises the act of conducting the compressed air along a meandering course in a body of the valve plate, and wherein an air guide is arranged in a plane of the valve plate.

8. The method according to claim 7, wherein the cooling act further comprises the act of conducting the coolant along a meandering course in a base of the valve plate.

9. The method according to claim 7, wherein the compressed air flows into the body of the valve plate through a plurality of air outlet valves.

10. The method according to claim 8, wherein the compressed air flows into the body of the valve plate through a plurality of air outlet valves.

* * * * *